US007270036B1

(12) United States Patent
Chen

(10) Patent No.: US 7,270,036 B1
(45) Date of Patent: Sep. 18, 2007

(54) TORQUE RATCHET WRENCH

(76) Inventor: Mu-Lin Chen, No.37-2 Ching-Dau 1st Street, Taichung (TW) 404

( * ) Notice: Subject to any disclaimer, the term of this patent is extended or adjusted under 35 U.S.C. 154(b) by 0 days.

(21) Appl. No.: 11/486,846

(22) Filed: Jul. 17, 2006

(51) Int. Cl.
*B25B 23/14* (2006.01)

(52) U.S. Cl. ..... 81/467; 81/52; 81/468

(58) Field of Classification Search ..... 81/52, 81/467, 468
See application file for complete search history.

(56) References Cited

U.S. PATENT DOCUMENTS 3,009,371 A * 11/1961 Hines et al. ..... 81/468
3,487,732 A * 1/1970 Larson ..... 81/467

* cited by examiner

*Primary Examiner*—Joseph J. Hail, III
*Assistant Examiner*—Shantese McDonald

(57) ABSTRACT

This invention relates to a torque ratchet wrench that comprises a wrench body with a handle at one end and a wrench head at the other end, a driving head would be used for connecting with work pieces, a control device being installed inside the wrench head for using to activate the driving head to run with turning of the wrench in one direction and to void the driving head to run with turning of the wrench in the other direction, a mark plate being implemented on the wrench body with notched torque scales, and an indicator being fixed on the wrench head at one end and extending to above the mark plate at the other end. When the wrench body is driving the driving head rotating, the torque value applied on the wrench driving the work piece can be measured from reading the pointing of the indicator to the notched torque scale on the mark plate.

5 Claims, 12 Drawing Sheets

TORQUE RATCHET WRENCH

FIELD OF THE INVENTION

The present invention relates to a torque ratchet wrench and more particularly to a torque ratchet wrench that is capable of measuring the torque value when it is driven.

BACKGROUND OF THE INVENTION

As per what have been acknowledged, the structure of a conventional torque wrench, as shown in FIGS. 11 and 12, comprises a wrench 7, a mark plate 8 and an indicator 9. The wrench 7 is formed by a wrench body 70 with a handle 71 at one end and a wrench head 72 at the other end. A driving head 73 is formed as one piece with the wrench head 72 for lodging into a work piece or a sleeve, and a fixing hole 720 is implemented on the wrench head 72. The mark plate 8 is firmly fixed on the wrench body 70 near the handle 71 and has notched torque scales 80 put onto. The indicator 9 is fixed on the fixing hole 720 at one end and extends to above the mark plate 8 at the other end.

However, since the wrench head 72 and the driving head 73 of the conventional torque wrench are formed as one piece, when the driving head 73 is lodged into a bolt assembly or a sleeve and then turned to certain degree of angle, the user has to take out the driving head 73 from the hole, turn it backward to certain degree of angle, and then lodge it back to the bolt or the sleeve for applying force on turning the wrench, which is presumed in such a way time and energy consuming and giving influence to working efficiency.

SUMMARY OF THE INVENTION

The main purpose of this invention is to provide a torque ratchet wrench that is capable of measuring the torque value when it is driven. The wrench is formed by a wrench body with a handle at one end and a wrench head at the other end. The wrench head contains a driving head and a control device; the driving head would be used for connecting with a work piece, the control device would be used to activate the driving head to run with turning of the wrench in one direction and to void the driving head to run with turning of the wrench in the other direction. A mark plate is implemented on the wrench body with notched torque scales, and an indicator is fixed on the wrench head at one end and extends to above the mark plate at the other end. When the wrench body is driving the driving head rotating, the torque value applied on the wrench driving the work piece can be measured from reading the pointing of the indicator to the notched torque scale on the mark plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
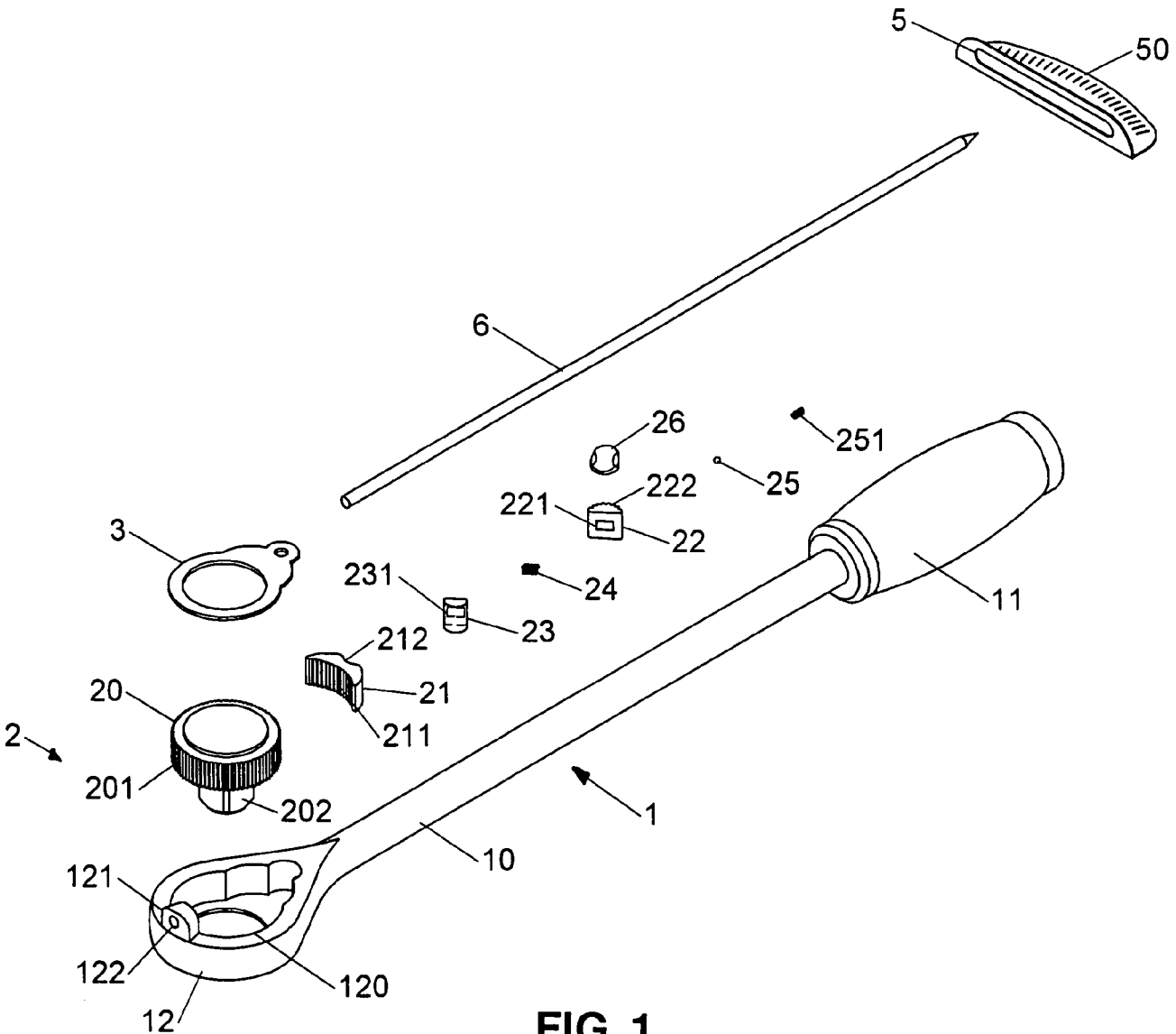
FIG. 1 is an exploded view of the first embodiment of the present invention.
Figure 2:
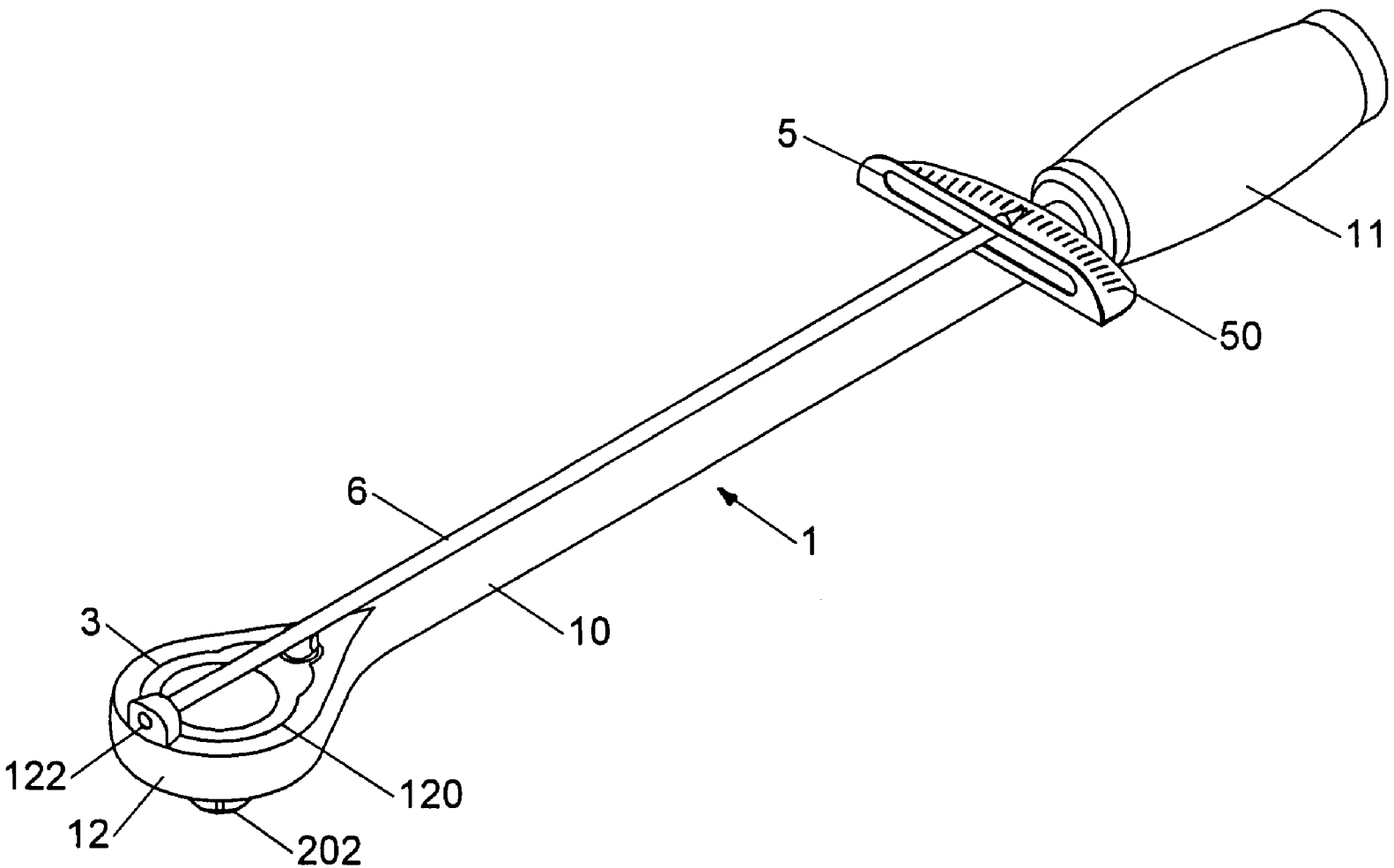
FIG. 2 is a perspective view of the first embodiment of the present invention.

As shown in FIGS. 1 and 2, the first embodiment of this invention, the torque ratchet wrench, comprises:

a wrench body 10 with a handle 11 at one end and a wrench head 12 at the other end. The wrench head 12 has an accommodation hole 120 and an extrusion 121 with a fixing hole 122;

a driving head 20 being installed in the accommodation hole 120 of the wrench head 12 to connect with and drive a work piece to rotate;

a control device 2 for controlling the driving head 20 to function in one direction. In the embodiment, the control device 2 comprises a moving piece 21 and a control piece 22; the driving head 20 is round and a plurality of ratchet teeth 201 is implemented on the periphery of the driving head 20. The moving piece 21 can move inside the accommodation hole 120; on the concaved side of the moving piece 21, a plurality of pawl teeth 211 is implemented to mesh with the ratchet teeth 201 of the driving head 20. The control piece 22 can be control from outside to move the moving piece 21 to mesh with one side of the driving head 20;

a cover 3 to retain the control device 2 in the accommodation hole 120;

a driving part 202 being formed as one piece with driving head 20 to be a salient on the bottom side of the driving head 20, which would be used to lodge in a bolt assembly or a sleeve;

a mark plate 5 with notched torque scales 50 put onto being installed on the wrench body 10; and an indicator 6 being installed on the fixing hole 122 of the extrusion 121 at one end and extending to above the mark plate 5 at the other end.

Therefore, through the use of control piece 22, the moving piece 21 would be moved to be matched with the ratchet teeth 201 on the driving head 20, when the wrench body 10 is rotating to one direction, the driving part 202 would be driven to rotate; on the other hand, when the wrench body 10 is rotating to the other direction, the driving part 202 would not be driven to rotate but void to act, then the objective of having uni-direction rotation is attained.

Figure 3:
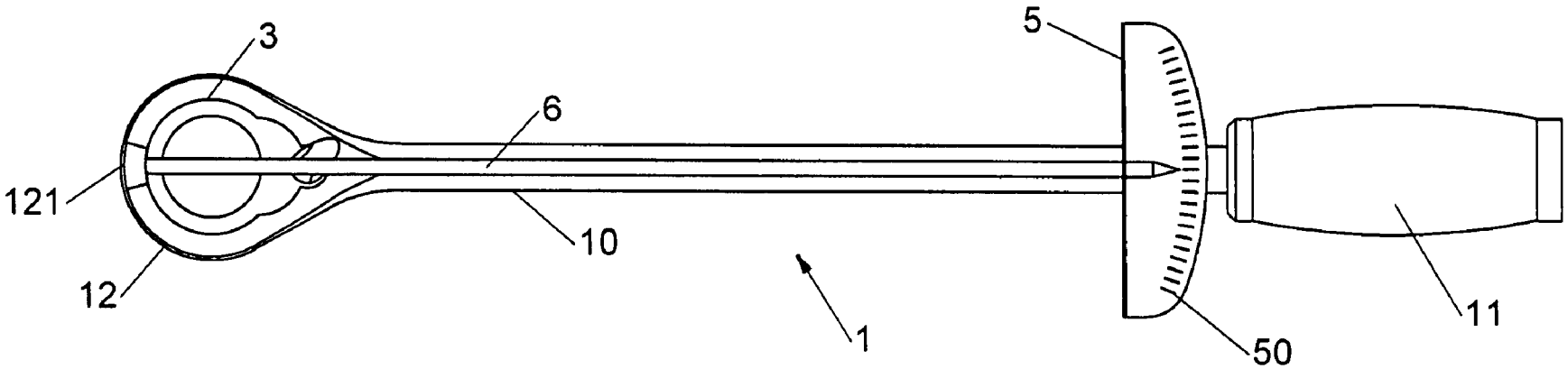
FIG. 3 is a top plan view of the first embodiment of the present invention.

Referring to FIG. 3, when the handle 11 is driving the wrench body 10 to rotate toward one direction, the wrench body 10 would be slightly bent, the indicator 6 being moving relatively to the mark plate 5, the point of the indicator 6 being indicating the notched torque scale 50 on the mark plate 5, the torque value at that moment would be derived.

Figure 4:
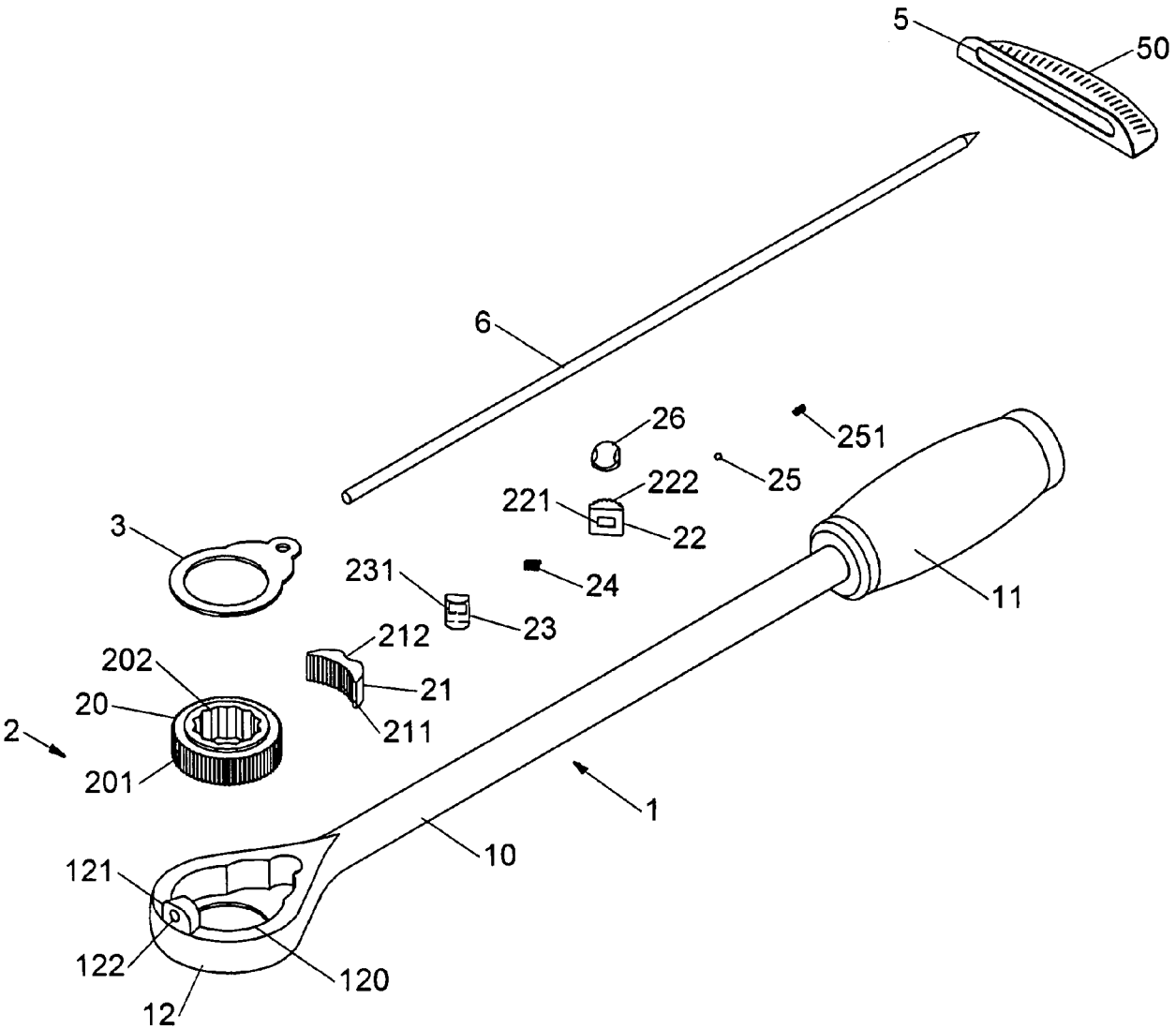
FIG. 4 is an exploded view of the second embodiment of the present invention.

Referring to FIG. 4, the second embodiment of this invention is featuring that the driving part 202 of the driving head 20 is formed as a sleeve that can be engaged with a work piece directly.

Figure 5:
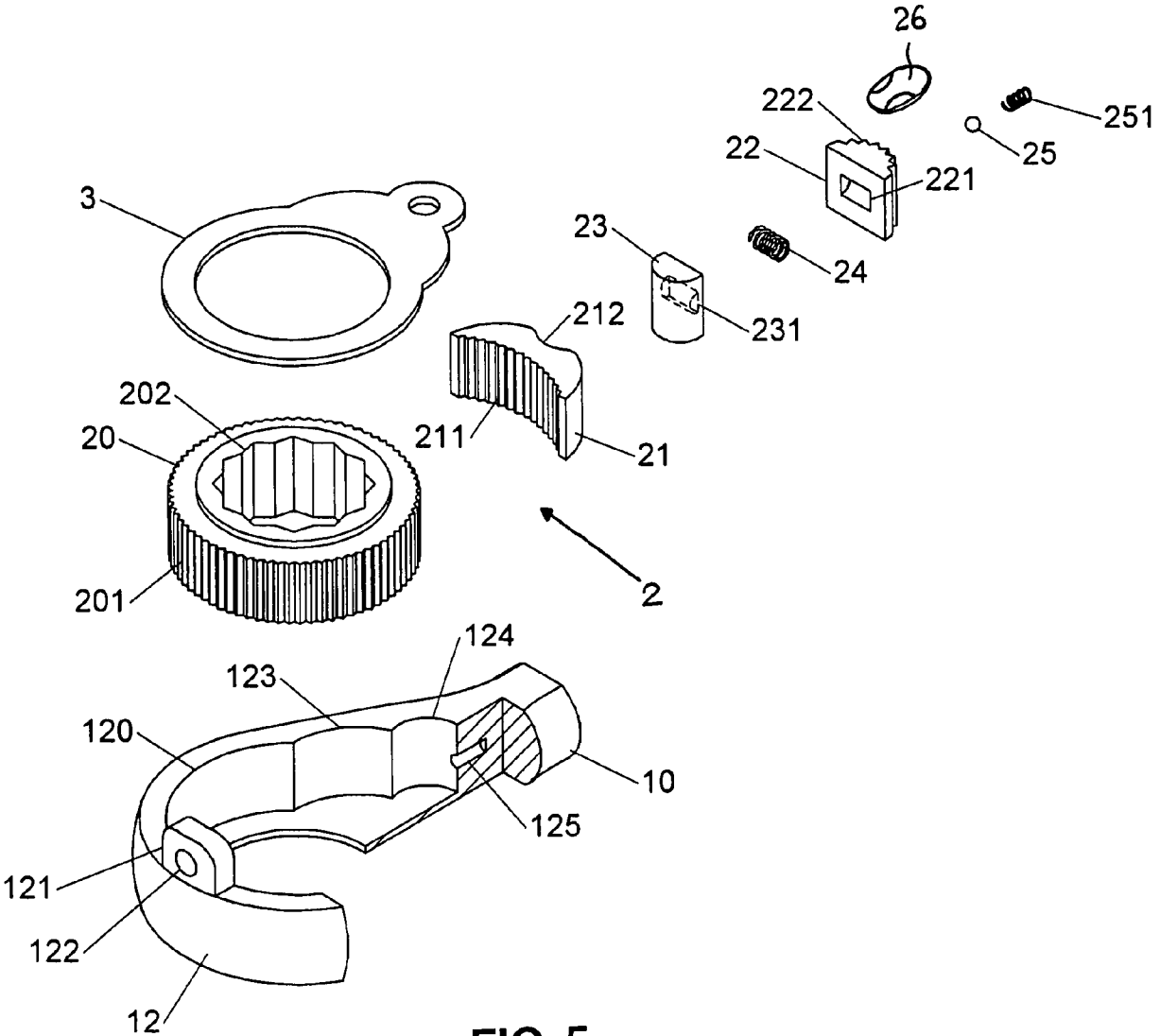
FIG. 5 is an exploded perspective view of the control device and the wrench head of the present invention.
Figure 6:
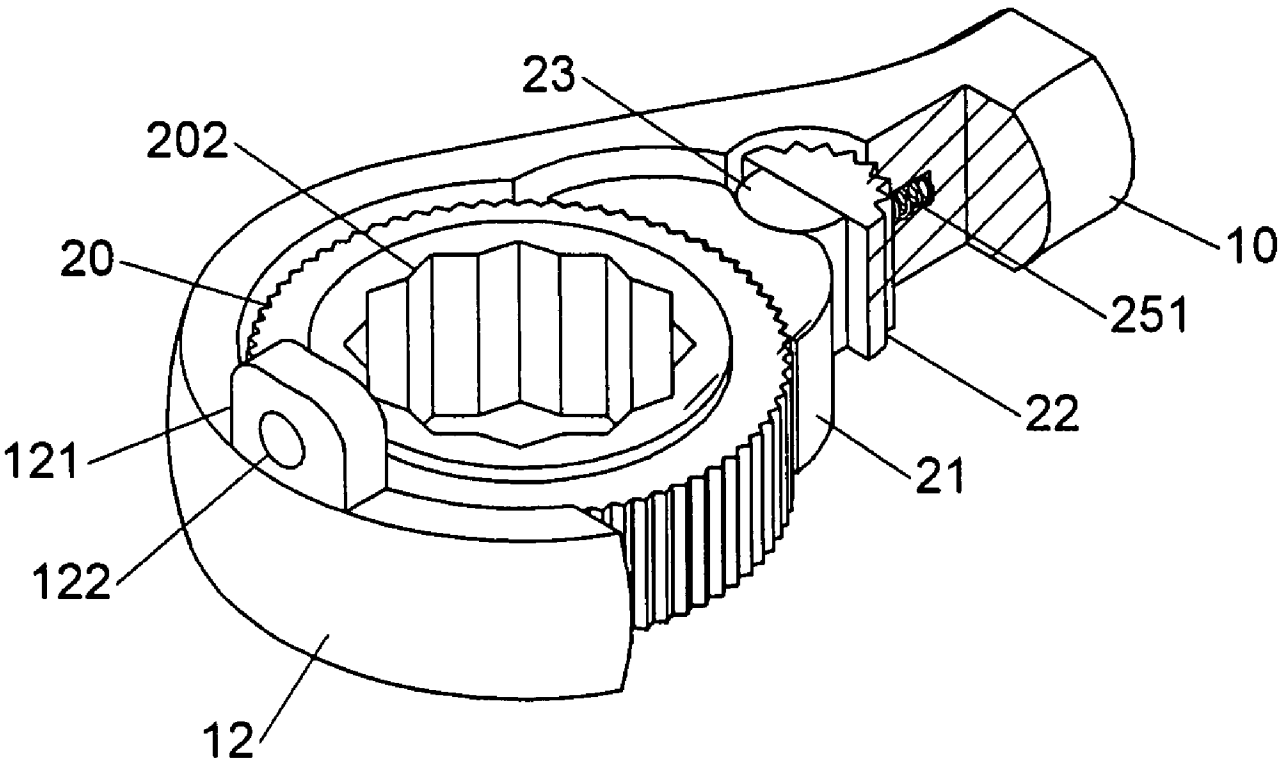
FIG. 6 is a perspective assembly view of the control device and the wrench head of the present invention.
Figure 7:
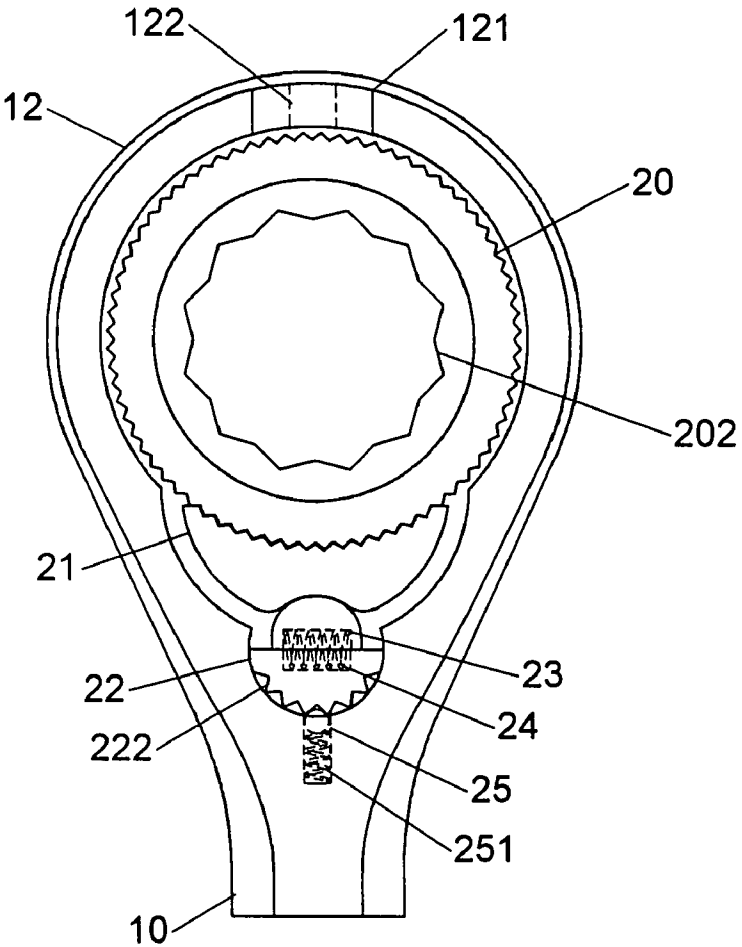
FIG. 7 is a top plan view of the control device and the wrench head of the present invention.

Referring to FIGS. 5 to 7, the wrench of this invention comprises a wrench body 10, a driving head 20, a moving piece 21, a control piece 22, a butt block 23, a spring 24, a steel ball 25, and a second spring 251. The wrench head 12 of the wrench body 10 has an accommodation hole 120, in which an accommodation groove 123 is implemented at one side, and a control groove 124, is implemented on one side of the accommodation groove 123; a ball groove 125 is implemented in radial direction on the wall of the control groove 124, inside which the spring 251 and a steel ball 25 are installed in sequence; the driving head 20 is installed in the accommodation hole 120 of the wrench head 12, a plurality of ratchet teeth 201 is implemented on the periphery of the driving head 20 and a driving part 202 is implemented in the center of the driving head 12; a moving piece 21 is provided in the accommodation groove 123, one side of the moving piece 21 is formed as pawl teeth 211 for meshing with the ratchet teeth 201 of the driving head 20, the other side of the moving piece 21 is formed as a stop edge 212, the stop edge 212 is urged by a butt block 23 to make the moving piece 21 meshed with the driving head 20. The control piece 22 is pivoted on the control groove 124 of the wrench head 12, one side of the control piece 22 is formed as a hemi-cylinder with a plurality of teeth 222 implemented therein for the steel ball 25 to be seized in, the other side has a slot 221 for accommodating the spring 24. A dial piece 26 is connected with the control piece 22, by turning the dial piece 26, the control piece 22 would rotate inside the control groove 124. The butt block 23 is formed as a hemi-cylinder at one side, and a second slot 231 referring to the slot 221 of the control part 22 is implemented at the other side, the second slot 231 and the slot 221 are integrated to possess the spring 24. The butt block 23 is pushed by the control piece 22 to butt on the stop edge 212 of the moving piece 21. A cover 3 is installed on the accommodation hole 120 for all the elements being possessed inside of the wrench body 10.

Figure 8:
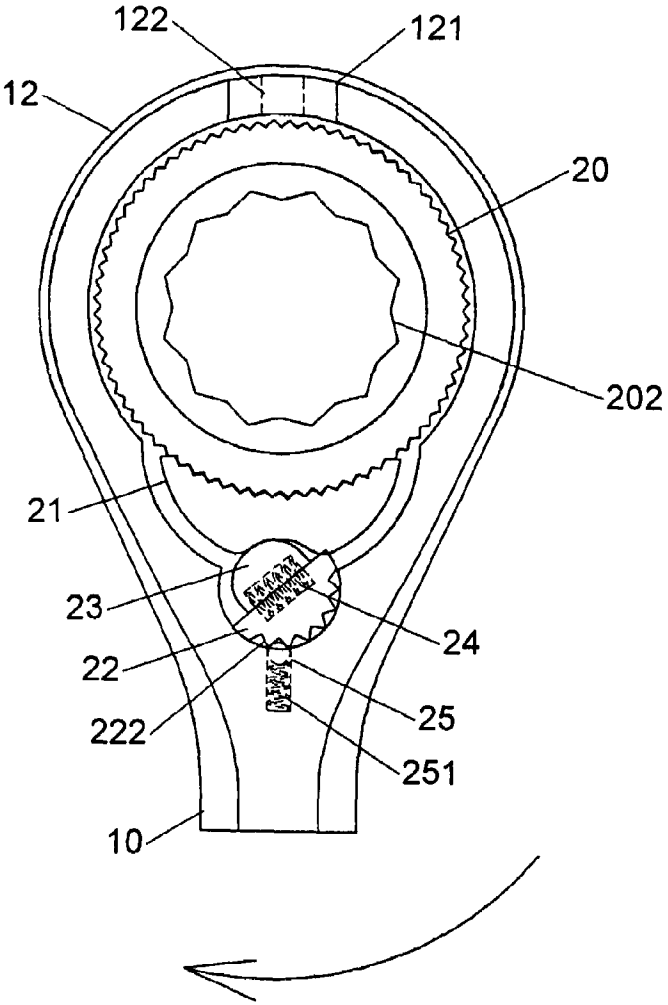
FIG. 8 is a top plan view showing the status of the control device when the wrench turns clockwise.

Referring to FIGS. 5 and 8, a user would first use the dial piece 26 to turn the control piece 22 to an appropriate degree inside the control groove 124, when the user turns the wrench body 10 clockwise, the control groove 124 of the wrench body 10 pushes the control piece 22 to urge the butt block 23 to butt on the stop edge 212 of the moving piece 21, and then the pawl teeth 211 of the moving piece 21 would mesh with the ratchet teeth 201 of the driving head 20, thereof the driving head 20 can be driven clockwise.

Figure 9:
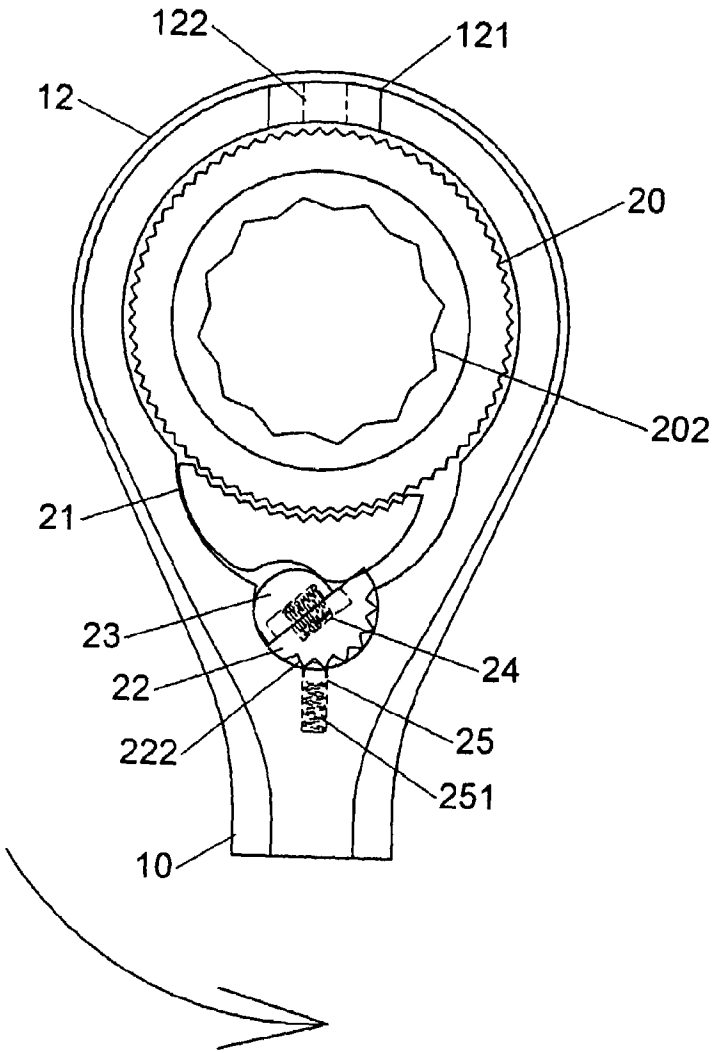
FIG. 9 is a top plan view showing the status of the control device when the wrench turns counterclockwise.

Referring to FIG. 9, when a user is rotating the wrench body 10 counterclockwise, the driving part 202 of the driving head 20 is engaged with a work piece and bears the counterforce thereof, the spring 24 installed between the control piece 22 and the butt block 23 is compressible allowing the pawl teeth 211 on the moving piece 21 to slip over with the teeth 201 of the driving head 20, therefore the wrench body 10 can not drive the driving head 20 counterclockwise.

Figure 10:
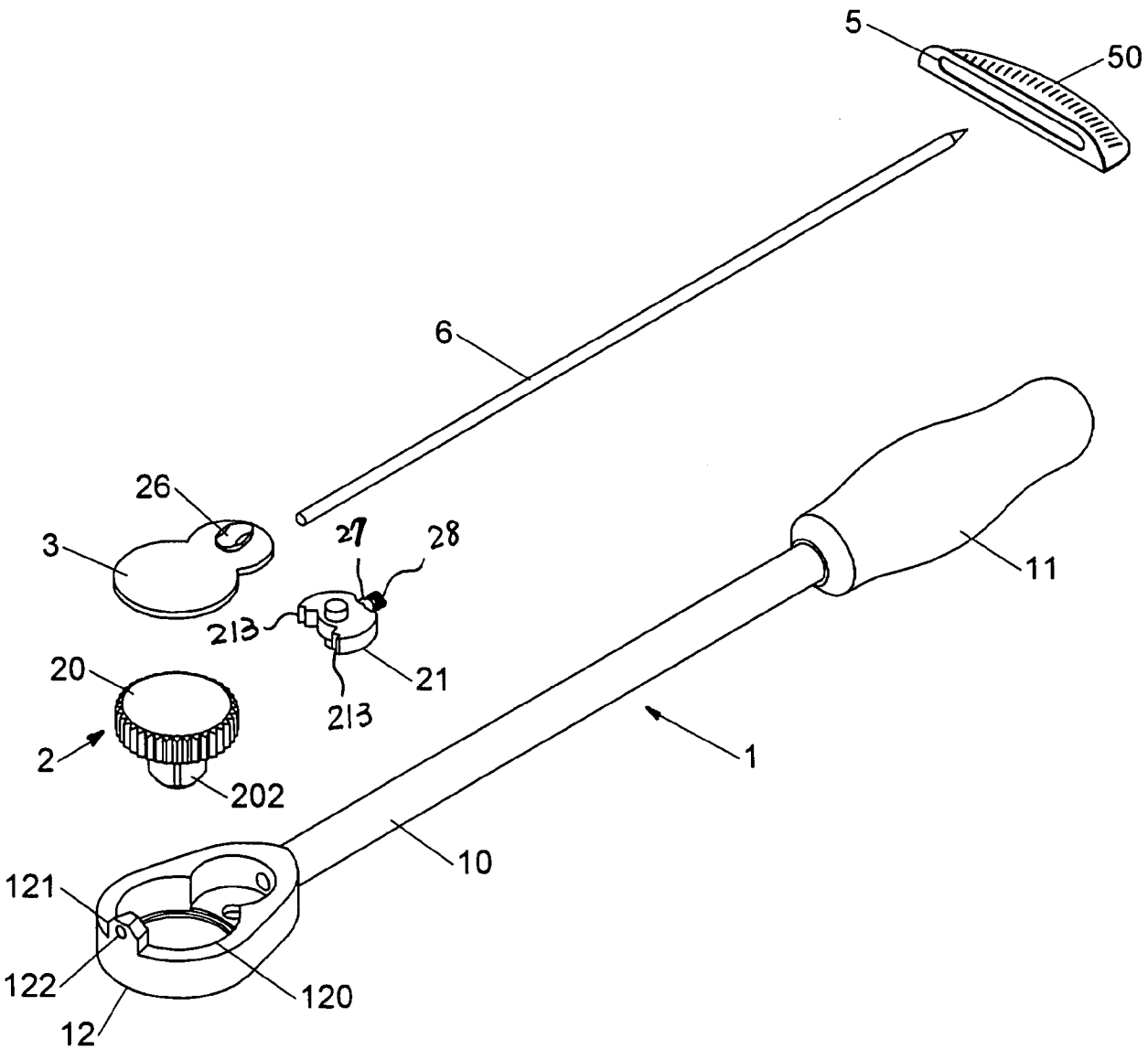
FIG. 10 is an exploded view of the third embodiment of the present invention.
Figure 11:
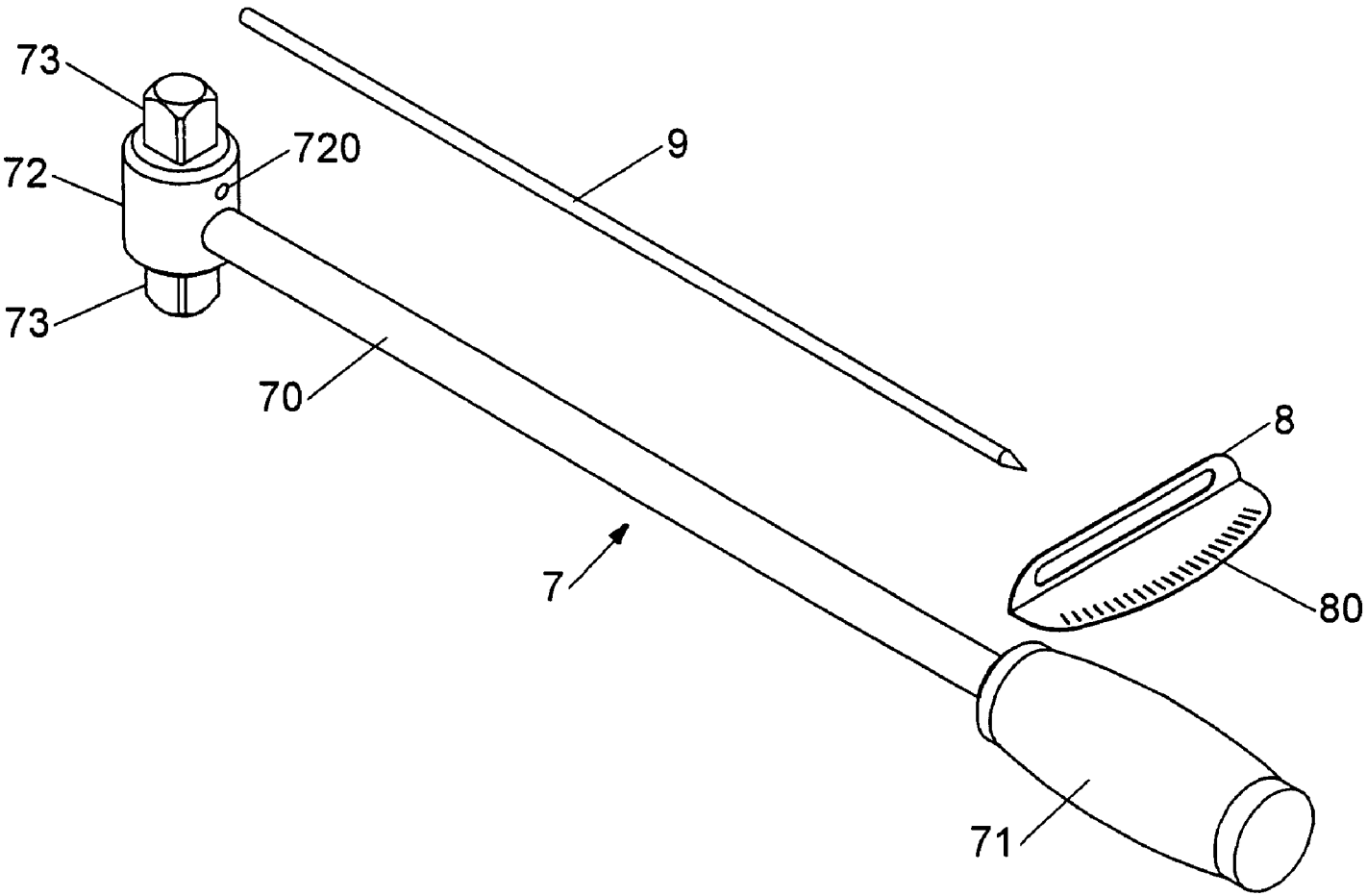
PRIOR ART FIG. 11
FIG. 11 is an exploded view of a prior art.
Figure 12:
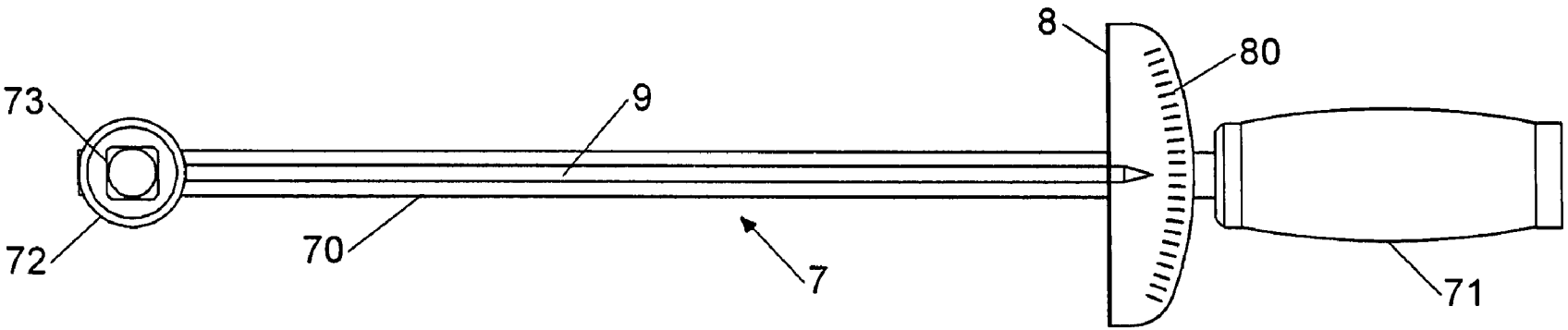
PRIOR ART FIG. 12
FIG. 12 is a top plan view of a prior art.

Referring to FIG. 10, the structure of another embodiment of this invention is similar to the first embodiment, yet the difference is that the moving piece 21 of the control device 2 is pivotally installed of being able to rotate in the accommodation hole 120 of the wrench 1, a plurality of teeth 213 is implemented on both sides of one end of the moving piece 21, a ball 27 is connected on the other end of the moving piece 21, and a spring 28 is connected to the ball 27.

While we have shown and described the embodiment in accordance with the present invention, it should be clear to those skilled in the art that further embodiments may be made without departing from the scope of the present invention.

What is claimed is:

1. A torque ratchet wrench comprising:

a wrench body having a handle on one end and a wrench head on the other end, the wrench head having an extrusion with a fixing hole and having an accommodation hole for accommodating a driving head and a control device, the driving head for connecting with a work piece, a plurality of ratchet teeth is implemented on the periphery of the driving head, the control device being installed in the accommodation hole of the wrench head for controlling the wrench body to drive the driving head to rotate in one direction, the control device includes at least a moving piece and a control piece, the moving piece can move inside the accommodation hole, on a first end of the moving piece, a plurality of pawl teeth is implemented to mesh with the ratchet teeth of the driving head, the control piece can be control from outside to move the moving piece, thereof the pawl teeth of the moving piece would mesh with the ratchet teeth of the driving head;

a mark plate with notched torque scales being installed on the wrench body; and an indicator with one end being fixed on the wrench head by inserted into the fixing hole of the extrusion of the wrench head, and the other end extending to above the mark plate.

2. The torque ratchet wrench as described in claim 1, wherein the plurality of pawl teeth is distributed on the first end of the moving piece.

3. The torque ratchet wrench as described in claim 1, wherein there is a sleeve on the center of the driving head for connecting a work piece.

4. The torque ratchet wrench as described in claim 1, wherein one part of the plurality of pawl teeth is formed on one side of the first end of the moving piece, and the other part of the plurality of pawl teeth is formed on the other side of the first end of the moving piece, a ball is connected with a second end of the moving piece, and a spring is connected to the ball.

5. The torque ratchet wrench comprising:

a wrench body having a handle on one end and a wrench head on the other end;

a driving head for connecting with work pieces;

a mark plate with notched torque scales being installed on the wrench body; and an indicator with one end being fixed on the wrench head and the other end extending to above the mark plate;

wherein the wrench head of the wrench body having an accommodation hole, in which an accommodation groove being implemented at one side, and a control groove being implemented on one side of the accommodation groove; a ball groove being implemented in radial direction on the wall of the control groove, inside which a spring and a steel ball being installed in sequence; the driving head being installed in the accommodation hole of the wrench head, a plurality of ratchet teeth being implemented on the periphery of the driving head and a driving part being implemented in the center of the driving head; a moving piece being provided in the accommodation groove, one side of the moving piece being formed as pawl teeth for meshing with the ratchet teeth of the driving head, the other side of the moving piece being formed as a stop edge, the stop edge being urged by a butt block to make the moving piece meshed with the driving head; a control piece being pivoted on the control groove of the wrench head, one side of the control piece being formed as a hemi-cylinder with a plurality of teeth implemented therein for the steel ball to be seized in, the other side has a slot for accommodating a spring; a dial piece being connected with the control piece, by turning the dial piece, the control piece would rotate inside the control groove; the butt block being formed as a hemi-cylinder at one side, and a second slot referring to the slot of the control part being implemented at the other side, the second slot and the slot being integrated to possess the spring.

* * * * *